US010792667B2

(12) United States Patent
Chang

(10) Patent No.: US 10,792,667 B2
(45) Date of Patent: Oct. 6, 2020

(54) DISPOSABLE WASTE SYSTEM FOR PAPER SHREDDER

(71) Applicant: Herman Chang, Rancho Dominguez, CA (US)

(72) Inventor: Herman Chang, Rancho Dominguez, CA (US)

( * ) Notice: Subject to any disclaimer, the term of this patent is extended or adjusted under 35 U.S.C. 154(b) by 0 days.

(21) Appl. No.: 15/333,094

(22) Filed: Oct. 24, 2016

(65) Prior Publication Data

US 2019/0134642 A1 May 9, 2019
US 2020/0261918 A9 Aug. 20, 2020

Related U.S. Application Data

(63) Continuation of application No. 14/477,678, filed on Sep. 4, 2014, now Pat. No. 9,480,989.

(60) Provisional application No. 61/873,570, filed on Sep. 4, 2013.

(51) Int. Cl.

| | |
|---|---|
| ***B02C 18/22*** | (2006.01) |
| ***B02C 18/00*** | (2006.01) |
| ***B02C 18/10*** | (2006.01) |
| ***B65F 1/00*** | (2006.01) |
| ***B02C 25/00*** | (2006.01) |
| ***B65F 1/14*** | (2006.01) |
| ***B02C 18/16*** | (2006.01) |

(52) U.S. Cl.

CPC ..... *B02C 18/2216* (2013.01); *B02C 18/0007* (2013.01); *B02C 18/10* (2013.01); *B02C 25/00* (2013.01); *B65F 1/0006* (2013.01); *B65F 1/1405* (2013.01); *B02C 2018/0061* (2013.01); *B02C 2018/164* (2013.01)

(58) Field of Classification Search

CPC ..... B30B 9/3035; B30B 9/30; B30B 9/3042; B30B 3/04; B65F 1/0006; B65F 1/1607; B02C 2018/0061; B02C 2018/0023; B02C 2018/0046; B02C 2018/0038; B02C 4/00; B02C 4/28; B02C 4/02; B02C 4/08; B02C 18/00; B02C 18/0007; B02C 18/06; B02C 18/08; B02C 18/10; B02C 18/16; B02C 18/22; B02C 18/2216; B02C 25/00

USPC ..... 241/33, 36, 100, 101.3, 221, 222, 227, 241/230, 235, 236

See application file for complete search history.

(56) References Cited

U.S. PATENT DOCUMENTS

| | | | |
|---|---|---|---|
| 4,923,126 | A | 5/1990 | Lodovico |
| 5,771,794 | A | 6/1998 | Benizri |
| 6,113,017 | A | 9/2000 | Tsai |
| 7,708,217 | B2 | 5/2010 | Huang |

(Continued)

FOREIGN PATENT DOCUMENTS

JP 2001293390 A * 10/2001 ..... B30B 9/3082

*Primary Examiner* — Shelley M Self
*Assistant Examiner* — Katie L. Parr
(74) *Attorney, Agent, or Firm* — Stefan J. Kirchanski; Matthew J. Spark; Zuber Lawler & Del Duca LLP

(57) ABSTRACT

The present invention involves a collapsible and disposable container that is inserted into a paper shredder to catch the shredded paper fragments. The disposable container has a relatively narrow slot-shaped opening having a length less than the longest dimension of the top of the container. A pair of counter-rotating rollers is supplied to compact the paper fragments and feed them through the slot and into the waste container. Various sensor systems, some constructed from conductive ink are used with and within the disposable container.

8 Claims, 4 Drawing Sheets

(56) References Cited

U.S. PATENT DOCUMENTS

| | | | | |
|---|---|---|---|---|
| 7,766,265 | B2 | 8/2010 | Wang | |
| 7,871,027 | B2 * | 1/2011 | Ko | B02C 18/0007 241/100 |
| 2006/0054725 | A1 * | 3/2006 | Matlin | B02C 23/04 241/37.5 |
| 2007/0145170 | A1 * | 6/2007 | Easton | B02C 18/0007 241/100 |
| 2007/0228196 | A1 * | 10/2007 | Abramson | B02C 18/0007 241/37.5 |
| 2008/0230640 | A1 | 9/2008 | Mussig | |
| 2008/0283640 | A1 * | 11/2008 | Montgomery | B02C 19/0075 241/27 |
| 2010/0181400 | A1 * | 7/2010 | Davis | B02C 18/0007 241/100 |
| 2011/0101137 | A1 * | 5/2011 | Langston | B02C 23/18 241/25 |

* cited by examiner

DISPOSABLE WASTE SYSTEM FOR PAPER SHREDDER

CROSS-REFERENCE TO PRIOR APPLICATIONS

This application is a continuation application of and claims priority from U.S. application Ser. No. 14/477,678, filed on 4 Sep. 2014, now U.S. Pat. No. 9,480,989, and further claims priority and benefit of U.S. Provisional Patent Application No. 61/873,570, filed 4 Sep. 2013, wherein each of the aforementioned applications is incorporated herein by reference in its entirety.

U.S. GOVERNMENT SUPPORT

Not Applicable.

BACKGROUND OF THE INVENTION

Area of the Art

The current invention concerns document security and more particularly a paper shredder with a disposable waste container.

DESCRIPTION OF THE BACKGROUND OF THE INVENTION

In spite of supposedly becoming a "paperless society" paper shredders remain an important item for ensuring security. In fact, the widespread use of the Internet to conduct all manner of business and financial affairs makes the inadvertent disclosure of even a single account number potentially disastrous. Because all manner of receipts and bills continue to disclose complete account numbers, it is imperative that one destroy this information prior to discarding the documents. The paper shredder remains the most effective way of ensuring that discarded documents do not reveal any personal information.

Although paper shredders have "evolved" quite a bit over the last few decades, the general details of their operation have remained fairly consistent. In the most common type of paper shredder, documents to be destroyed are fed into a slot or input chute. Within the shredder a series of rotating cutting blades are spaced along a drive shaft. The inserted document meets these blades and is cut into innumerable pieces which fall from the shredding mechanism and into a waste storage container or bin. The blades are spaced apart along a length that is at least as long as the width of the widest document to be shredded. Normally this is at least 8½ inches so that the shredded paper exits the mechanism along a path that is at least 8½ inches long although some desktop shredders designed for bi-fold paper can have a shredding mechanism less than 8½ inches long. In any case, the storage container must have a minimum dimension of at least the length of the shredding mechanism with an opening to admit the shredded paper fragments of at least this length. Generally, the container is essentially open-topped to ensure that all the shredded fragments fall into the container; with such a large opening, it is easy to spill fragments during the process of emptying or replacing the storage container. This makes the emptying or replacement process cumbersome and messy. Most often, the open-topped storage container is removed from the shredder and dumped into a waste basket. This often results in a blizzard of paper fragments. Some mess can be avoided by dumping the container into a larger building trash bin, but this requires taking the container out of the office to the trash bin location. An alternative strategy is to empty the waste storage container into a disposable (plastic) trash bag which can more readily be carried to the trash bin. However, it turns out to be difficult to achieve the transfer of paper fragments from the waste container to the trash bag without spreading paper fragments all over the place.

Most modern paper shredders have a number of automatic sensors and controls. An input sensor detects the presence of documents in the input slot and starts the shredder motor. The motor continues to operate for some seconds after documents are no longer present at the input to allow the paper fragments to clear the mechanism and fall into the storage bin. Other sensors stop the motor if it becomes overloaded or overheated. Finally, a "bin full" sensor stops the motor when the storage bin becomes full. If shredding were to continue with the bin full, the shredded fragments could no longer fall freely from the shredder mechanism. Instead the mechanism would become clogged and the motor would overheat.

SUMMARY OF THE INVENTION

The present invention involves a collapsible and disposable container that is inserted into a paper shredder to catch the shredded paper fragments released by the shredding mechanism. The disposable container has a relatively narrow slot-shaped opening having a length less than the length of the container top. A pair of counter-rotating rollers is supplied to compact the paper fragments and feed them through the slot and into the disposable container.

The invention can include embodiments having enclosures with frames to hold the disposable container or enclosures without frames. The invention can include mechanisms to fasten the top of the container to the inside of the enclosure or to the top of the frame. Similarly, mechanisms can be supplied to fasten the bottom of the container to the inside bottom of the enclosure or the bottom of the frame. The container can be fully expanded prior to insertion into the frame or enclosure or either the top or the bottom of the container can be attached first and the container then fully expanded. When the container has become filled with paper fragments, it can be removed from the enclosure and the opening sealed (e.g. with a self-adhesive flap) to prevent accidentally spillage of shredded paper fragments.

Various sensor systems are provided to ensure that the disposable container is properly expanded and inserted into the shredder enclosure in a proper manner. A bin full sensor can be provided by an extension protruding from the paper shredder and into the disposable container either through the slot-shaped opening or through a separate opening provided for that purpose. The bin full sensor can also be provided by sensors, e.g., photo-sensors and light sources that sense the status of the container through transparent or translucent windows provided in the container walls. The bin full sensor can also be provided by sensors that weigh the disposable container or by various disposable mechanical switches that are fabricated from conductive ink and are located on an inner surface of the disposable container.

BRIEF DESCRIPTION OF THE FIGURES

FIG. 4A showing the complete sensor; FIG. 4B showing the structure on the inner container wall; and FIG. 4C showing the folded paper switching mechanism.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a disposable waste container for a paper shredder.

The art still needs a solution to the problem of difficulty of emptying a paper shredder without making a mess. A solution to this problem is to replace the waste storage container with a disposable container that can be sealed simply and dumped in the trash when full, thereby avoiding all the mess occasioned by attempting to transfer paper fragments from one container to another. It has been already been pointed out that shredder waste containers are usually open-topped so that they are difficult to seal even if a disposable container is supplied. The present inventor has realized that there is no need to provide an open-topped container. All that is needed is a disposable container having a slot-shaped opening that is oriented parallel to the long axis of the shredding mechanism.

Figure 1:
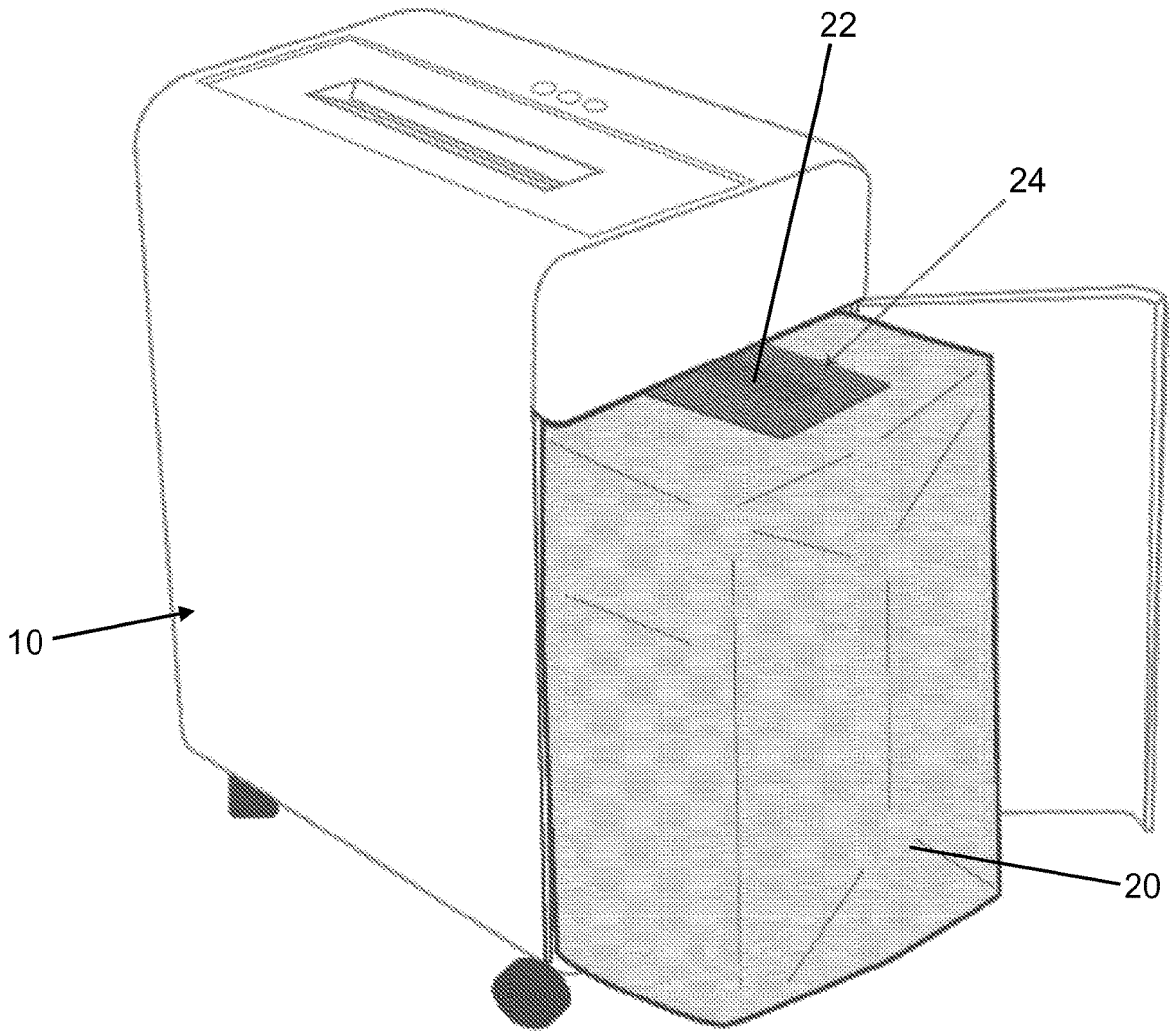
FIG. 1 is a drawing of a shredder with a disposable container partially inserted therein.

FIG. 1 shows a drawing of a shredder 10 with a disposable waste container 20 according to the present invention. The interior of the shredder is designed to accommodate a disposable bag-like or box-like container. In the drawing the container 20 takes up most of the interior space of the shredder 10. The container 20 has a slot-shaped opening (or "feed slot") 22 in a more or less rigid panel 24 (e.g., a cardboard surround) on the upper surface of the disposable container 20. When the container is inserted into the paper shredder, the opening aligns with the discharge region (not illustrated here) of the shredder 10. This allows the paper fragments to simply fall through the opening 22 and into the container. When the container is full, the opening 22 can be closed or sealed—e.g. with an adhesive flap—and tossed in the trash. Ideally, the box or bag is designed to be stored in a flattened or collapsed configuration. The container is expanded before or during insertion into the paper shredder. It should be understood that while the container 20 is shown here with one opening or feed slot 22, there may be two or more openings designed to match the waste drop area of the shredding mechanism. Most current shredders have a single slot-shaped waste drop area-hence the single opening 22 illustrated.

A problem with this arrangement is that the shredding process tends to "fluff" the paper fragments with the result that they are loose and not compacted in the disposal container. This results in the container filling with mostly air. This has long been a problem with open-topped waste container where manufacturers have implemented a number of devices such as stirrers and tampers to ensure that the paper fragments are optimally compacted. If no such device is provided, the user simply pulls out the waste container and manually compresses the fragments when the "bin full" alarm sounds. These strategies are not effective with the disposable slot opening waste container disclosed here. A foldable box or bag with a slot-shaped opening makes it difficult to implement a mechanical stirrer or tamper because the dosed container prevents the use of mechanical linkages. Likewise, the narrow slot opening makes it virtually impossible for the user to reach in and mechanically compress the fragments.

In addition, the fluffy paper fragments also make it difficult to implement a "bin full" sensor. In conventional open-topped waste containers, some sort of sensor depends from the shredder mechanism and extends into the container. When the container becomes nearly full, the sensor is triggered and the shredding mechanism is stopped so that fragments don't back up and clog the mechanism. A narrow slot opening makes it difficult to implement such a system. An alternate proposal is to use a weight sensor (either beneath the container or as part of the mechanism from which the disposable container is suspended within the shredder) to determine when the container is full. The problem with this approach is that it assumes that shredded fragments have a standard density. Considering that a wide variety of paper stock ranging from ordinary copier paper to highly coated paper stock is frequently shredded weight is not a good predictor of fragment volume particularly if the fragments are fluffy and entrap a large volume of air. If a paper density that is too high is selected, the weight sensor will fail to stop the shredding mechanism before the container is about to overflow. If a lower density is chosen to prevent overflow, the shredder will be stopped before the container is actually full when non-fluffy material is shredded. One possible solution is to implement a method to reduce fragment fluffing and compact the fragments before they fall into the waste container. Not only does this result in a more efficient use of waste container space, it results in the average fragment density being more consistent so that a weight sensor can act as a "full bin" sensor.

Figure 2:
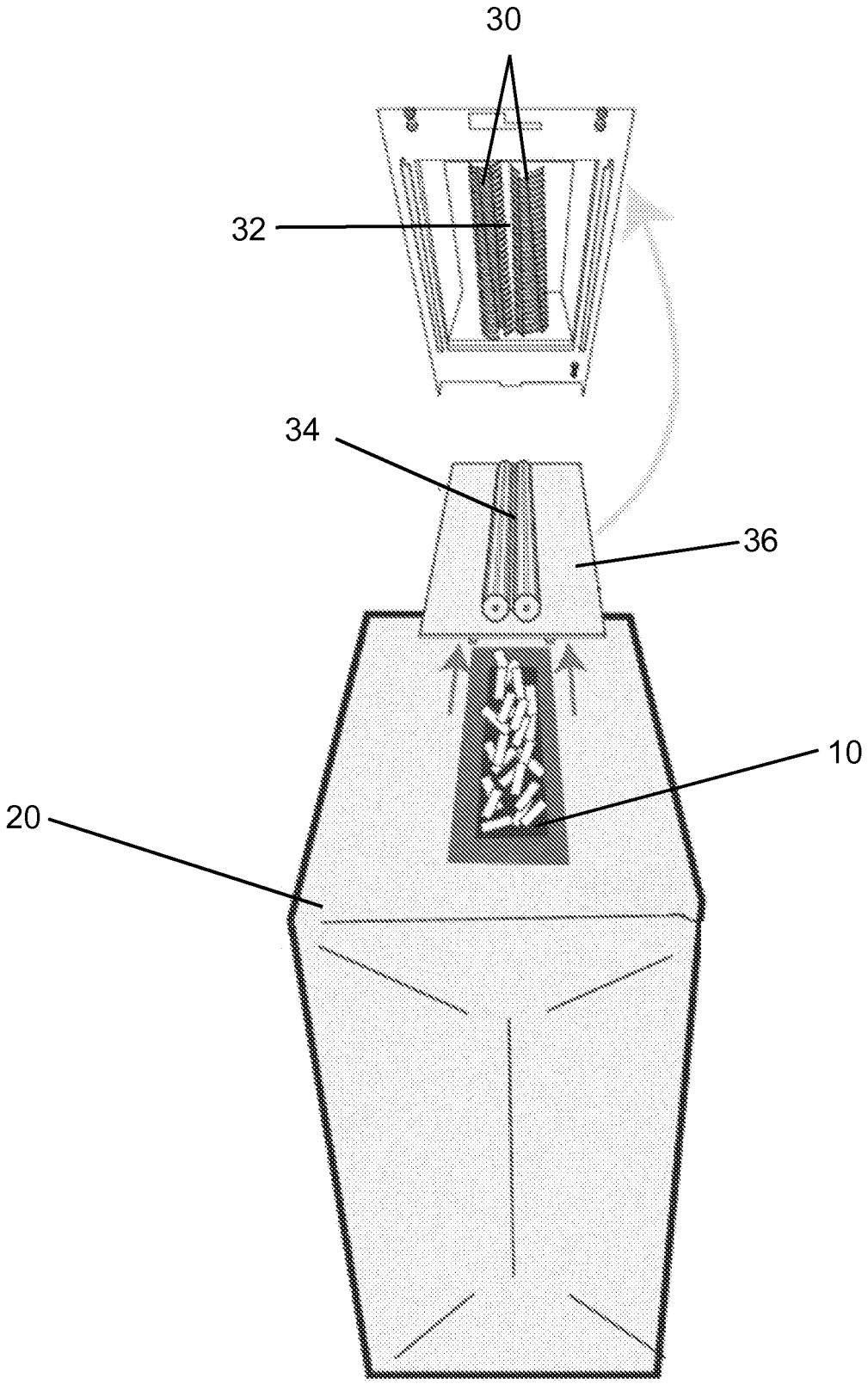
FIG. 2 Is an "exploded view" drawing showing the underside of a shredder mechanism, a roller plate with compaction rollers and disposable container showing how these parts interrelate.

FIG. 2 shows an exploded view of one embodiment of a fragment compacting system for use with a slot-opening disposable waste container 20. As in FIG. 1 the disposable container 20 has a slot-shaped opening 22 (filled with paper fragments) approximately coinciding with the shredder mechanism's waste drop area 32 (here an area set by the length and width of the two shafts bearing 30 shredding blades). However, disposed between the shredding mechanism and the container 22 is a pair of compaction rollers 34 carried by a roller plate 36. These rollers are essentially smooth rubber or plastic rollers that may have shallow grooves or a papillate or "dimpled" surface to aid in gripping the fragments. The rollers are counter rotating and rotate towards the small space between the rollers. The rollers 34 are designed to engage with the shredder motor so that they will rotate when the motor operates. Alternatively, the rollers 34 can be activated by a separate motor or by a clutch linked to the main motor so that the rollers 34 do not necessarily always operate when the shredder mechanism operates.

This combination works rather like an old-fashioned wringer washing machine to compact and squeeze the air from fluffy paper fragments. The compacted fragments then fall through the slot and into the disposable container where they fill the container in a compact fashion. The roller plate shown in the drawing is flat but it may also be formed in a "V" of funnel shape with the rollers at the bottom of the "V"

to ensure that all of the fragments interact with the rollers. The rollers 34 can advantageously be resiliently biased together so that thicker fragments can force the rollers apart and pass through to the disposable container without jamming. It is also possible to provide a lever or other mechanism that moves the rollers apart at one or both ends to facilitate clearing of paper jams.

Figure 3:
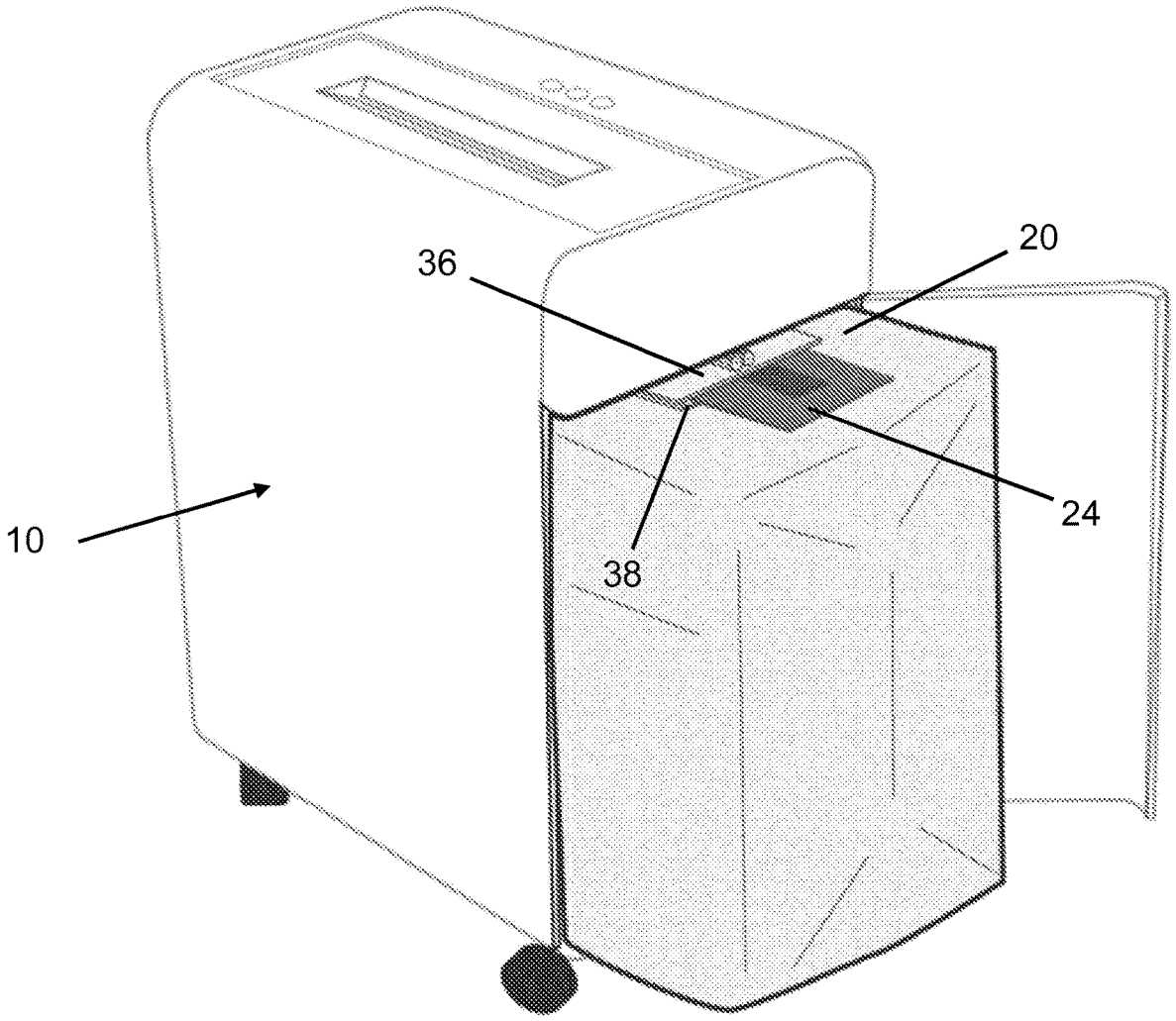
FIG. 3 Is a drawing showing a shredder with a partially inserted disposable container showing how the roller plate engages with the disposable container.

FIG. 3 shows an embodiment wherein the disposable container 20 interacts with the roller plate 36 (in the drawing the more or less rigid panel (e.g., a cardboard surround) 24 of the feed slot 22 slides into a matching retainer-slot 38 depending from the roller plate 36) to ensure a tight seal. Other attachment mechanisms can be used. In this embodiment, the roller plate can be partially withdrawn from the unit to simplify this process of inserting the disposable container. The roller plate can also be withdrawn to deal with paper jams. A series of sensors ensure that the unit cannot operate unless the disposable container 20 is inserted and the roller plate 36 is correctly installed.

Ideally the disposable container 20 will be made of inexpensive recyclable material. The proper choice of material and configuration can ensure optimal operation. One potential goal is to ensure jam-free operation. When the disposable container becomes full, fragments may start to back up into the roller plate 36 and then into the shredding mechanism resulting in a potential paper jam. Therefore, the ability to accurately detect a full container is important. There are several possible methods for implementing a full container sensor. As discussed above, it is possible to calculate the approximate weight of paper fragments that will fill the volume of a given container. Then, the container can either hang from the shredder outflow which incorporates a weight sensor (e.g. a spring system or a piezoelectric sensor), or the container can rest on a weight sensor. In either case, the operation of inserting a new empty container can cause the sensor to zero so that the tare weight of the container is not measured. When the container has accumulated the full weight of fragments, the weight sensor activates a "full container" alarm which stops the shredding mechanism so that the container can be replaced.

Alternately, the level of fragments within the container can be sensed directly—by means of either electromagnetic or ultrasonic radiation. If the container is transparent to a particular wavelength of electromagnetic radiation (or has transparent windows in its sides), the level of fragments can be detected by interruption of a beam of the radiation. In such a configuration the electromagnetic source (e.g. an LED) can be fixed to one wall of the enclosure and the detector (e.g. a phototransistor) located on the opposite wall. When the container is properly inserted into the enclosure, windows in the wall of the container line up with the source and detector. Alternatively, a portion of the roller plate can extend into the container and carry the light source and detector so that when the fragments pile up to reach the detector, the light beam is permanently interrupted and the shredding mechanism stops. The extension can, as another alternative, bear an ultrasonic transducer that acts as both source and detector. The transducer projects an ultrasonic beam to the bottom of the container and returning echoes are used to calculate the distance to the container bottom or the fragments lying on the bottom. A potential problem with electromagnetic or sonic detection of container filling is that loosely consolidated fragments can cause a "false alarm" by interrupting the beam before the container is completely filled. Although the roller plate significantly compacts the fragments, it may be advantageous to add a vibrator to induce additional settling of the fragments.

Figure 4A:
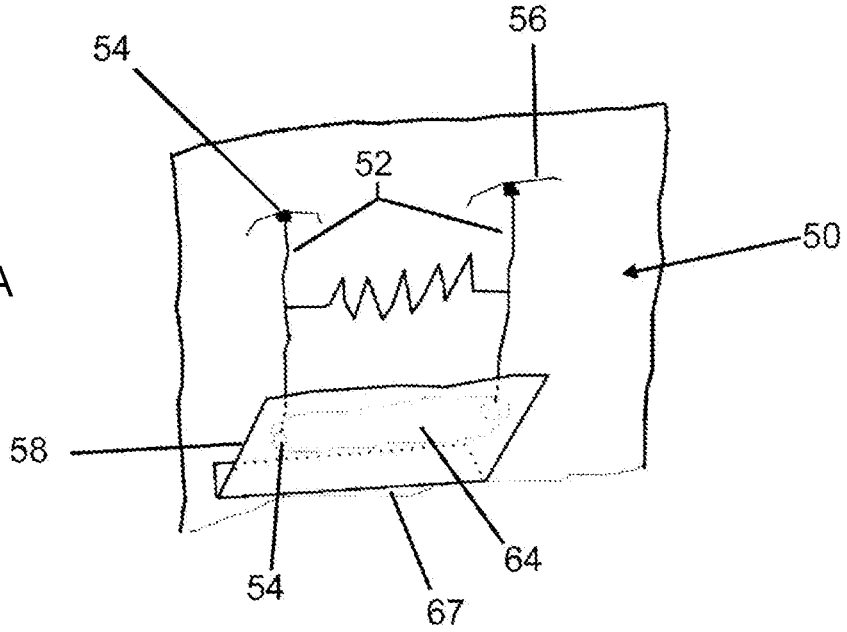
FIGS. 4A to 4C show a series of three views to explain a conductive ink bin full sensor.
Figure 4B:
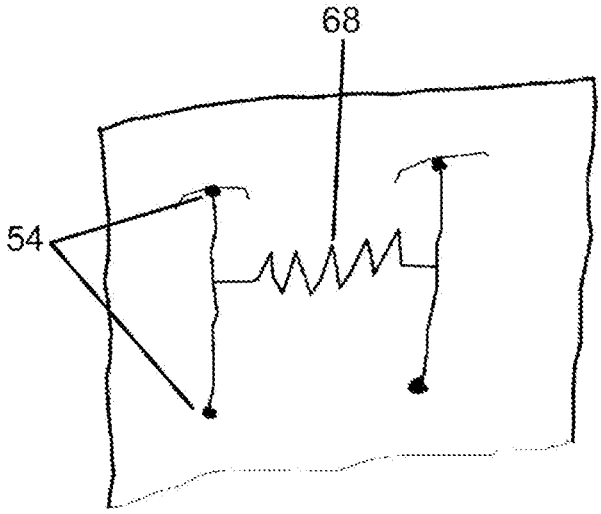
Figure 4C:
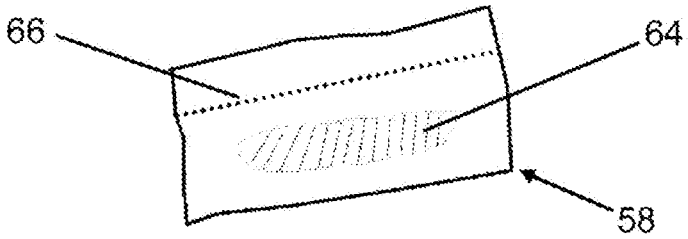

A simple "bin full" sensor can also be incorporated into the disposable container. For example, a folded piece of heavy paper or light cardboard can be glued to the upper side or top of the disposable container (as shown in FIG. 4). FIG. 4A shows the inner surface 50 of the disposable container 20. Two lines of conductive ink 52 bear round conductive pads 54 at either end. Staples 56 at the upper ends of the lines allow electrical communication through the container wall. When the disposable container is inserted onto the roller plate, the electronic connection is made between the shredder electronics and the conductive ink switch by means of two staples 56. A piece of folded paper or shirt board 58 is attached by adhesive to the container wall 50 in such a position that the upper part of the folded paper 58 will be pressed against the pads when the container fills up with fragments of shredded paper. A conductive area 64 is printed on the folded paper 58 with conductive ink. When the contents of the container press on the folded paper, it deforms so that the lead closes a circuit between two conductive pads 54. The orientation of the folded paper can be with the fold parallel to the bottom or the sidewall of the container or any angle therebetween. Similarly, the open flap can be up or down or to the side. Ideally, several such switches with different orientation will be included in a container. Although the disposable container includes a "bin full" switch, it is still completely disposable because the switch is made of conductive ink (conductive organic polymer) and staples. For the sake of clarity FIG. 4B shows the staples and conductive lines without the folded paper. FIG. 4C shows the conductive area 64 on the reverse surface of the paper that acts as a switch. The dotted line 66 shows the position of the fold 67. The circuit from the switch to the shredder controller is accomplished by means of the staple. When the disposable container is properly inserted into the shredder, contacts or "brushes" within the shredder make electrical contact with the staples. This servers as a first insertion detector; when the contacts make electrical connection with the staples, they detect the presence of the printed resistor 68 directly connecting the staples. If this resistance is not detected, the container is not correctly installed. When the bin full switch, is actually closed, the resistance of the circuit drops significantly. Additional pairs of resistor linked staple pairs can be located on different parts of the container to provide additional insurance against an improperly inserted or improperly unfolded container. Also, a plurality of switches can be included positioned at various distances from the bottom of the container 20 so that the system can display an indication of how full the container 20 has become.

Although various rigid disposable containers can be used, collapsible containers are particularly favored because they take up little space when stored before use. One design consists of a flexible sack with a rigid and planar top (e.g. cardboard); or at least a rigid top portion surrounding an input opening. Such a container can be readily stored flat (with several in a package less than one inch in thickness) before use. It is also possible to make such a container with both top and bottom portions rigid (e.g. cardboard) joined by flexible side walls of paper or plastic film. In one embodiment the shredder simply has a hinged door on one side. This door is opened to allow insertion of the empty collapsible container after it has been expanded by the user. The top of the container can be accepted by slots on the roller plate as described above. Various sensors ensure that the container is inserted in the correct orientation so that the opening in the container will coincide with the exit from the roller plate. For optimum operation, it is important that the container be maximally expanded before it is inserted. One method of ensuring this is to provide slots into which the rigid portion of the container top slides so that the container hangs. Then a series of photo sensors disposed along the height dimension of the shredder enclosure can be used to determine whether the container has been fully extended. If it is not properly extended, the shredder will not operate and will display a message telling the user to ensure that the container is fully extended. In addition, the disposable container can be constructed with struts that snap into place when the user expands the container so as to hold the container in an expanded configuration.

In an alternate embodiment a rigid (metal or plastic) frame is slidingly mounted within the shredder enclosure. When the shredder side door is opened, the frame can be slid out and the bottom of the disposable container clipped to the bottom of the frame. The planar top can then be then lifted to expand the disposable container and fixed in place at the top of the frame (or the top can be fixed first with the contained being then extended towards the bottom of the frame). Again, conductive circuits within the container or external sensors can be used to confirm that the container is properly expanded. At this time the disposable container largely fills and is supported by the frame with the paper fragment entry opening at one side of the planar top. When the frame and container are slid back into the enclosure, the end (possibly with container-full sensors) of the roller plate assembly can automatically be moved down to interface with the container opening. If the interface is not successful (container incorrectly inserted or wrong type of container inserted) the shredding mechanism cannot be activated.

The invention can include embodiments having enclosures with frames to hold the disposable container or enclosures without frames. The invention can include means to fasten the top of the container to the inside of the enclosure or to the top of the frame. Similarly, means can be supplied to fasten the bottom of the container to the inside bottom of the enclosure or the bottom of the frame. The container can be fully expanded prior to insertion into the frame or enclosure or either the top or the bottom of the container can be attached first and the container then fully expanded. When the container has become filled with paper fragments, it can be removed from the enclosure and the opening sealed (e.g. with a self-adhesive flap) to prevent accidental spillage of shredded paper fragments.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. A paper shredder with a disposable waste container comprising:

an enclosure comprising:

in an upper region of the enclosure a shredding mechanism with an input for paper to be shredded and an output delivering shredded paper fragments at an elongated exit zone;

in a lower region of the enclosure a disposable container having at least one slot-shaped opening for receiving shredded paper fragments; and disposed between the upper and the lower regions, a roller plate including a retainer-slot and a pair of counter-rotating rollers that accept the paper fragments from the exit zone, compact the paper fragments and deliver the compacted paper fragments into the at least one slot-shaped opening; wherein the container operationally engages the retainer-slot.

2. The paper shredder according to claim 1, further comprising a disposable bin full sensor within the container fabricated from conductive ink.

3. The paper shredder according to claim 1, further comprising a container insertion verifying sensor comprising conductive ink.

4. The paper shredder according to claim 1, wherein a portion of the roller plate extends into the container.

5. The paper shredder according to claim 1, wherein the enclosure defines an interior space within the paper shredder, the roller plate being configured to move between a first position within the interior space of the enclosure and a second position at least partially outside the interior space of the enclosure.

6. The paper shredder according to claim 1, wherein distance between the rollers is adjustable.

7. The paper shredder according to claim 1, further comprising a frame configured to support the container.

8. The paper shredder according to claim 7, wherein the enclosure defines an interior space within the paper shredder, the frame being configured to move between a first position within the interior space of the enclosure and a second position at least partially outside the interior space of the enclosure.

* * * * *